US006033154A

United States Patent [19]

Curtis et al.

[11] Patent Number: 6,033,154

[45] Date of Patent: Mar. 7, 2000

[54] WASTE PROCESSING ATTACHMENT AND METHOD FOR ENVIRONMENTALLY TREATING A WASTE LAGOON

[75] Inventors: Don V. Curtis, Monroe; Edward J. Labus, Ann Arbor, both of Mich.

[73] Assignee: J.A. Jones Environmental Services Company, Monroe, Mich.

[21] Appl. No.: 09/129,287

[22] Filed: Aug. 5, 1998

[51] Int. Cl.[7] ..... C09K 17/00; B09B 1/00; E02F 3/96

[52] U.S. Cl. ..... 405/263; 37/403; 405/128; 405/269

[58] Field of Search ..... 405/128, 129, 405/267, 266, 263, 264, 269; 37/903, 403, 466

[56] References Cited

U.S. PATENT DOCUMENTS

| | | | |
|---|---|---|---|
| 3,072,257 | 1/1963 | Hockenberry | 37/403 X |
| 4,069,678 | 1/1978 | Miura et al. | 405/263 |
| 4,303,507 | 12/1981 | Smith | 37/903 X |
| 4,652,180 | 3/1987 | Jenkins | 405/128 X |
| 4,714,379 | 12/1987 | Gilchrist | 405/267 X |
| 4,769,977 | 9/1988 | Milbourn . | |
| 4,844,839 | 7/1989 | Manchak | 405/263 X |
| 4,906,142 | 3/1990 | Taki et al. . | |
| 5,013,185 | 5/1991 | Taki . | |
| 5,028,010 | 7/1991 | Sansing . | |
| 5,127,765 | 7/1992 | Millgard . | |
| 5,135,058 | 8/1992 | Millgard et al. . | |
| 5,256,001 | 10/1993 | Millgard . | |
| 5,353,998 | 10/1994 | Sansing . | |
| 5,368,415 | 11/1994 | Kono et al. . | |
| 5,378,085 | 1/1995 | Kono et al. . | |
| 5,417,522 | 5/1995 | Kono et al. . | |
| 5,493,796 | 2/1996 | Ballew et al. | 37/403 X |
| 5,631,160 | 5/1997 | Bruso | 405/263 X |
| 5,765,966 | 6/1998 | White et al. | 405/263 X |
| 5,771,612 | 6/1998 | Lynch | 37/403 X |

FOREIGN PATENT DOCUMENTS

WO 95/06401 3/1995 WIPO .

OTHER PUBLICATIONS

"The ENRECO Hydro Injection System"; Enreco Inc.; pp. 3–7; Published prior to Jun. 19, 1997.

"MecTool—A Revolutionary Patented System for In Situ Remediation"; Millgard Environmental Corporation; Entire Brochure; Published prior to Jun. 19, 1997.

"S.M.W. Cutoff Wall Technique for Containment of Hazardous Waste"; S.M.W.; Seiko, Inc.; pp. 10–11; Published prior to Jun. 19, 1997.

"Twin Header Blender—Toxic Waste Warrior"; Mitsui Machinery Distribution, Inc.; Entire Brochure; Published prior to Jun. 19, 1997.

"Slashbuster Excavator Mounted Stirring Attachment"; D & M Machine Division, Inc.; Entire Brochure; Published prior to Jun. 19, 1997.

"Technical Specifications for ITEX Heavy Duty In–Situ Mixing/Processing Equipment"; ITEX Environmental Services, Inc.; Entire Brochure; Published prior to Jun. 19, 1997.

*Primary Examiner*—Dennis L. Taylor
*Attorney, Agent, or Firm*—Adams Law Firm, P.A.

[57] ABSTRACT

A self-propelled vehicle includes a waste processing attachment. The vehicle is adapted for being moved over a supporting surface, and has a moveable working arm for reaching outwardly from the vehicle and downwardly beneath an adjacent surface of a waste lagoon. The waste processing attachment injects and mixes a waste processing material into the lagoon. The attachment includes a bucket mounted on a free end of the moveable working arm, and having a plurality of spaced-apart waste sifting openings. A material delivery line extends along the working arm of the vehicle, and has a connecting end connected to a material supply source and a discharge end residing proximate the bucket. Waste processing material flowing through and exiting the delivery line beneath the surface of the waste lagoon is discharged into a target area directly adjacent the bucket and mixed with the waste as the bucket is carried by the working arm through the lagoon.

19 Claims, 5 Drawing Sheets

WASTE PROCESSING ATTACHMENT AND METHOD FOR ENVIRONMENTALLY TREATING A WASTE LAGOON

TECHNICAL FIELD AND BACKGROUND OF THE INVENTION

This invention relates to a waste processing attachment for a self-propelled vehicle, such as an industrial excavator, and a method for environmentally treating solid, semi-solid, and liquid sludge waste. Such waste is commonly generated as a by-product of industrial plants, and then stored in man-made lagoons for subsequent treatment. The invention discharges sludge-hardening reagent to a predetermined target area below the surface of the lagoon, and mixes the reagent and waste together. The resulting mixture causes the lagoon to harden over a period of about 7–21 days. After treatment, the solidified lagoon is capped with a protective layer and used as a parking lot, equipment storage area, or the like.

According to one prior art waste treatment system, a reagent slurry is pumped from a remote location to a backhoe excavator, and then discharged into the sludge lagoon. In lieu of a bucket, the excavator includes a reagent injector fork with hollow tines attached to the stick for injecting and mixing the reagent slurring into the sludge waste. As reagent flows through the injector tines, the operator repetitively rakes the fork through the sludge until a sufficient amount of reagent is mixed into the area being treated.

Unlike the invention, the prior art system discharges the reagent slurry over a relatively large area, and randomly mixes by raking the fork through the lagoon. The prior art system does not discharge to a predetermined target area, and does not capture and mix the reagent slurry immediately as it enters the sludge waste. Random discharge of reagent and mixing in the above manner would typically result in poorly treated areas having non-uniform hardness and consistency.

SUMMARY OF THE INVENTION

Therefore, it is an object of the invention to provide a waste processing attachment for a vehicle which efficiently and effectively treats sludge waste.

It is another object of the invention to provide a waste processing attachment for a vehicle which treats sludge waste in situ.

It is another object of the invention to provide a waste processing attachment for a vehicle which provides direct delivery of reagent below grade to a predetermined target area.

It is another object of the invention to provide a waste processing attachment for a vehicle which immediately captures and mixes the reagent slurry as it enters the sludge waste.

It is another object of the invention to provide a waste processing attachment for a vehicle which allows precise control of the amount of reagent delivered to the sludge lagoon.

It is another object of the invention to provide a waste processing attachment for a vehicle which provides more efficient, uniform mixing of the reagent and biochemicals with the sludge waste.

It is another object of the invention to provide a waste processing attachment for a vehicle which reduces the quantity of reagent required to treat a given area.

It is another object of the invention to provide a waste processing attachment for a vehicle which produces better consistency in the solidified treated area.

It is another object of the invention to provide a waste processing attachment for a vehicle which discharges and holds reagent in a target area until uniformly mixed with the sludge waste.

It is another object of the invention to provide a method for environmentally treating a sludge waste lagoon.

These and other objects of the present invention are achieved in the preferred embodiments disclosed below by providing a self-propelled vehicle with a waste processing attachment. The vehicle is adapted for being moved over a supporting surface, and has a moveable working arm for reaching outwardly from the vehicle and downwardly beneath an adjacent surface of a waste lagoon. The waste processing attachment injects and mixes a waste processing material into the lagoon. The attachment includes a bucket mounted on a free end of the moveable working arm, and having a plurality of spaced-apart waste sifting openings. A material delivery line extends along the working arm of the vehicle, and has a connecting end connected to a material supply source and a discharge end residing proximate the bucket. Waste processing material flowing through and exiting the delivery line beneath the surface of the waste lagoon is discharged into a target area directly adjacent the bucket and mixed with the waste as the bucket is carried by the working arm through the lagoon.

According to one preferred embodiment of the invention, the waste sifting openings include an arrangement of relatively small, spaced-apart holes formed in the bucket.

According to yet another preferred embodiment of the invention, the waste sifting openings further include a second arrangement of relatively large spaced-apart slots formed in the bucket.

According to yet another preferred embodiment of the invention, the open area defined by each slot is at least 4 times greater that the open area defined by each hole.

According to yet another preferred embodiment of the invention, the open area defined by each hole is between 8 and 10 square inches.

According to yet another preferred embodiment of the invention, the open area defined by each slot is between 40 and 50 square inches.

According to yet another preferred embodiment of the invention, a plurality of teeth are formed along a bottom edge of the bucket to facilitate movement of the bucket into and through the waste lagoon.

According to yet another preferred embodiment of the invention, the vehicle is a backhoe excavator.

According to yet another preferred embodiment of the invention, the material delivery line includes a section of steel pipe mounted to the working arm of the vehicle and terminating at a point adjacent to and forward of the bucket.

A method for environmentally treating a waste lagoon uses a self-propelled vehicle adapted for movement over a supporting surface, and having a moveable working arm for reaching outwardly from the vehicle and downwardly beneath an adjacent surface of the waste lagoon. The method includes the steps of mounting a bucket on a free end of the moveable working arm. The bucket has a plurality of spaced-apart waste sifting openings. The discharge end of a material delivery line is located proximate the bucket, and is connected at its opposite end to a material supply source. The working arm is manipulated to move the bucket into and through the lagoon while simultaneously delivering waste processing material from the supply source through the delivery line to a target area directly adjacent the bucket. The working arm and bucket cooperate to mix the processing material and waste together to environmentally treat the lagoon.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
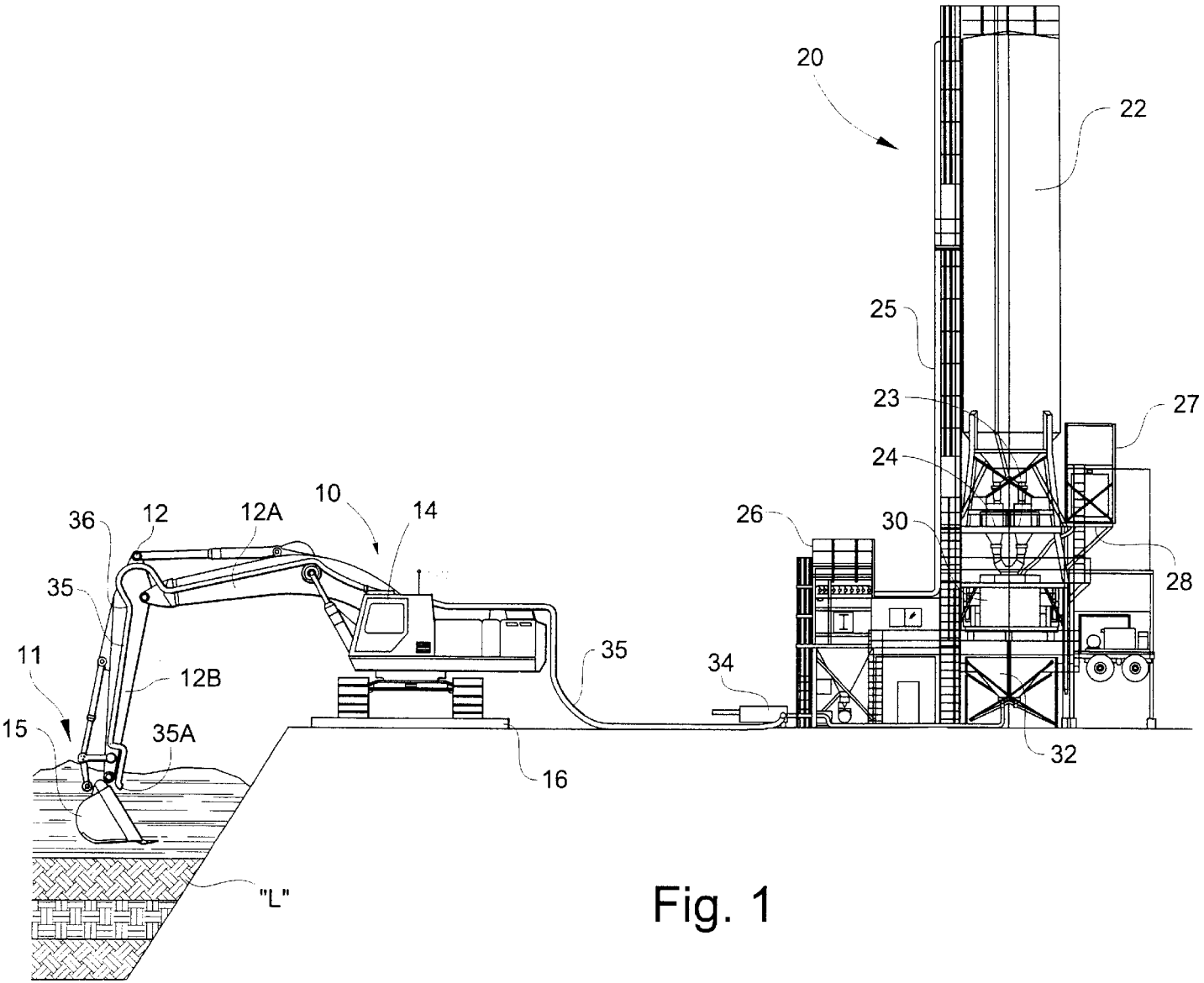
FIG. 1 is an environmental view of a waste processing attachment according to one preferred embodiment of the invention, and showing the attachment secured to the moveable working arm of a vehicle.

Referring now specifically to the drawings, a self-propelled vehicle including a waste processing attachment according to the present invention is illustrated in FIG. 1, and shown generally at reference numeral 10. The waste processing attachment is shown generally at numeral 11. The vehicle 10 includes a movable working arm 12 with a pivotably attached boom 12A and stick 12B controlled by an operator in the vehicle cab 14. The waste processing attachment 11 is secured to the working arm 12, and includes a mixing bucket 15 mounted on a free end of the stick 12B and carried by the working arm 12 outwardly from the cab 14 and downwardly beneath the surface of a sludge waste lagoon "L". Timber mats 16 or other suitable structure are laid over the ground surface adjacent the lagoon "L" to support the vehicle 10 during operation of the working arm 12. According to one preferred embodiment, the vehicle 10 is a standard industrial excavator, such as the CAT 375L manufactured by Caterpillar, Inc. of Aurora, Ill.

Figure 2:
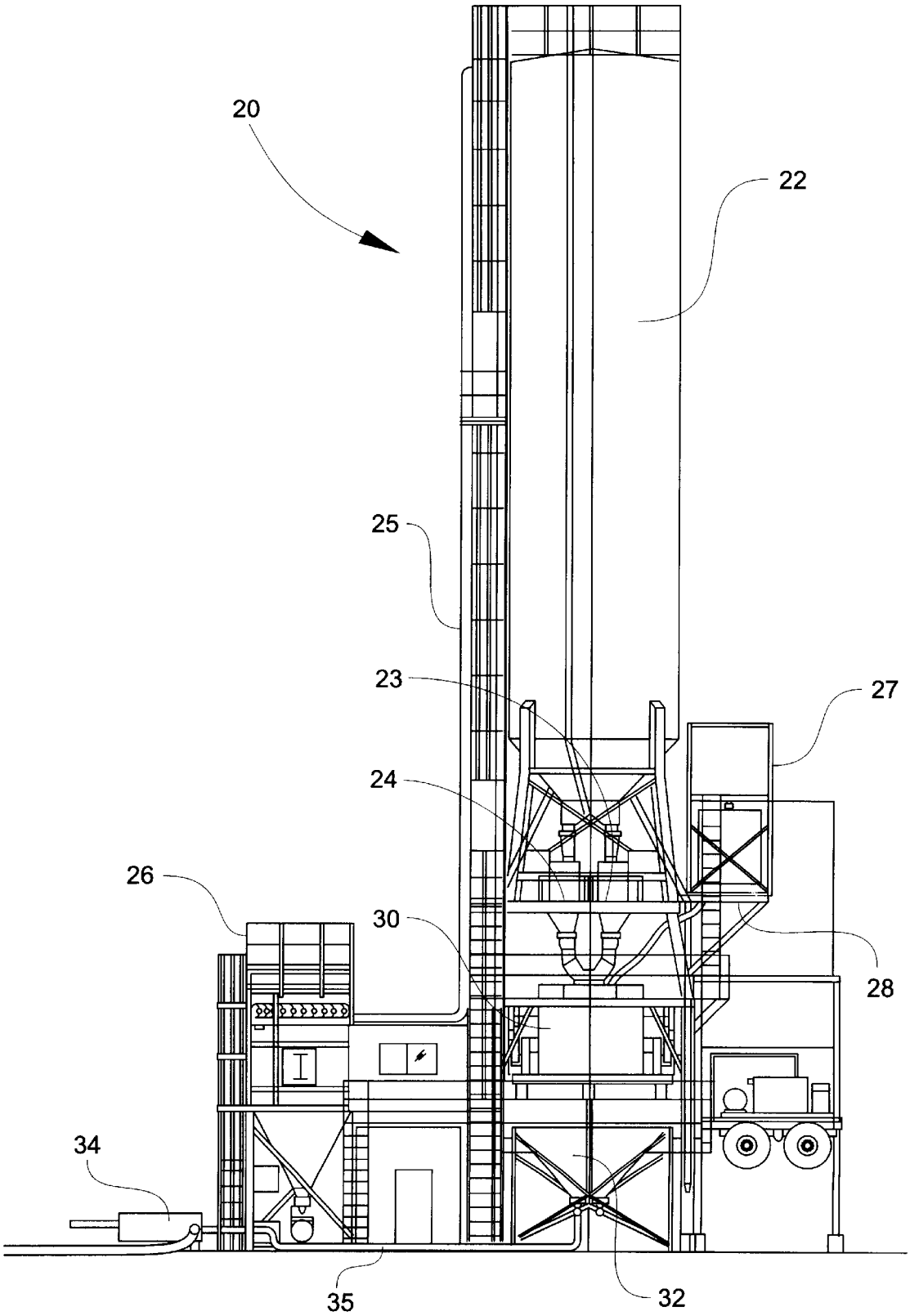
FIG. 2 is an elevational view of the reagent batch plant.

As shown in FIGS. 1 and 2, a reagent batch plant 20 is located remote from the vehicle 10, and includes a storage silo 22 with separate compartments for storing fly ash and cement. Each compartment includes two 4-inch diameter aeration pipes to prevent material packing, and promote outward flow of material through open discharge valves and into respective weigh batchers 23 and 24. A vacuum line 25 is connected to a dust vent formed in the silo 22, and extends to a freestanding, continuous-cleaning dust collector 26 for controlling the amount material dust entrained in the atmosphere within and around the silo 22.

A water holding tank 27 is mounted adjacent the silo 22, and includes a water weigh batcher 28 and delivery hose 29 extending from the batcher 28 to a horizontal shaft ribbon mixer 30. The mixer 30 is described in further detail in U.S. Pat. No. 4,854,711 incorporated herein by reference. The fly ash and cement are discharged from respective batchers 23 and 24 into the mixer 30 and combined and mixed with the water to create a reagent slurry having about one part water and two parts reagent. The reagent slurry is stored in a supply hopper 32, and conveyed by a slurry pump 34 from the hopper 32 through a delivery line 35 to the vehicle 10. The pump 34 is preferably capable of conveying reagent slurry through 4000 feet of delivery line 35.

Figure 3:
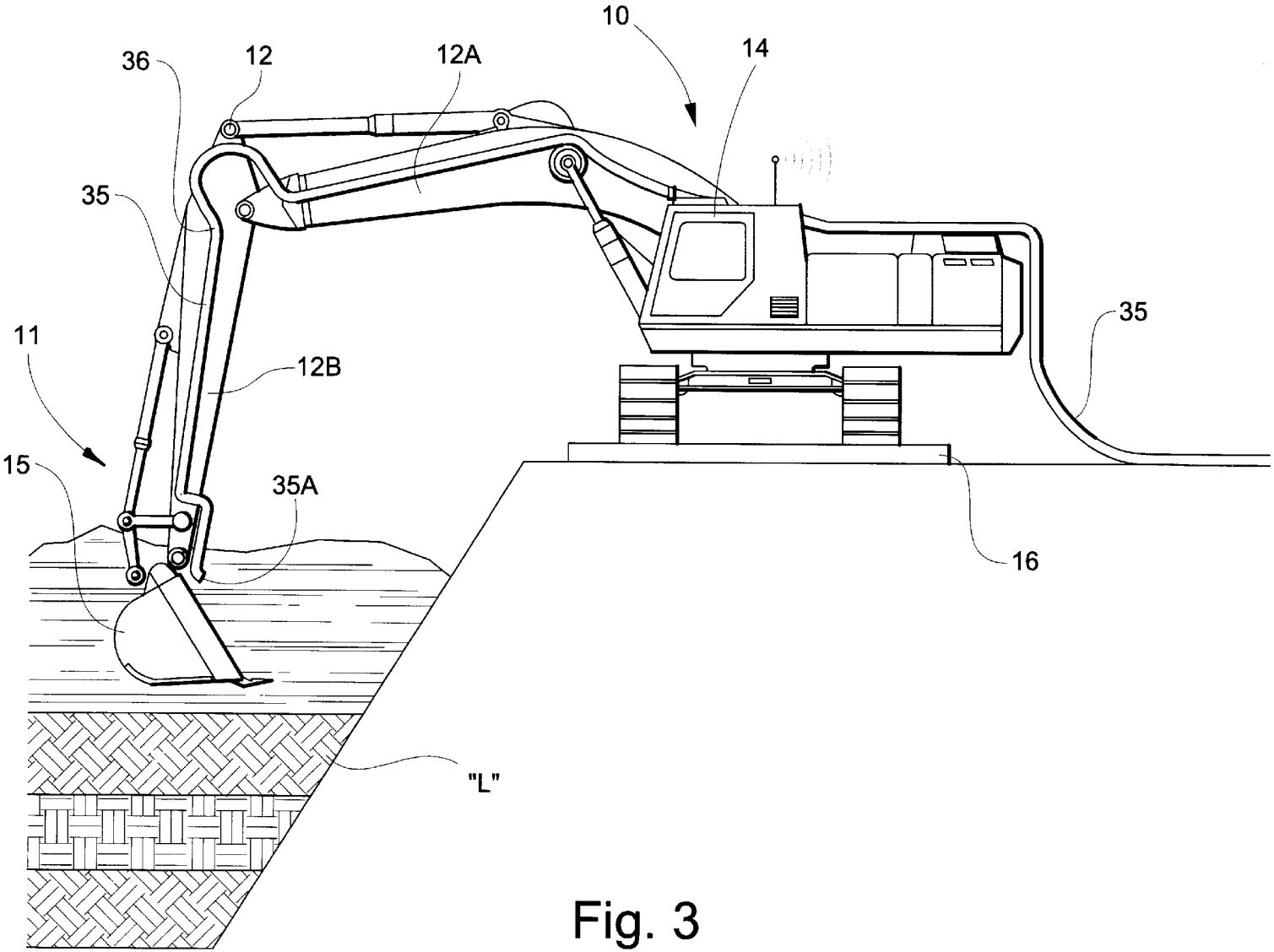
FIG. 3 is an elevational view of the waste processing attachment and vehicle, and showing the mixing bucket submerged beneath the surface of the sludge waste lagoon.

As best shown in FIGS. 1 and 3, the delivery line 35 is formed in sections of 4-inch diameter steel pipe extending from the supply hopper 32 to the pump 34 to the vehicle 10, and preferably includes quick connect flanges and couplers at every 15 feet of pipe length. The length of delivery line 35 at the vehicle 10 and extending along the boom 12A is formed of 4-inch diameter flexible hose to allow free movement of the working arm 12 into and about the lagoon "L". A final section of delivery line 35 is formed of 4-inch diameter steel pipe which is welded directly to the stick 12B of the working arm 12 and connected to the flexible hose section by a coupler 36. The steel pipe construction at the stick 12B protects the delivery line 35 from damage caused by contacting solid or semi-solid masses contained in the lagoon "L" during treatment.

Figure 4:
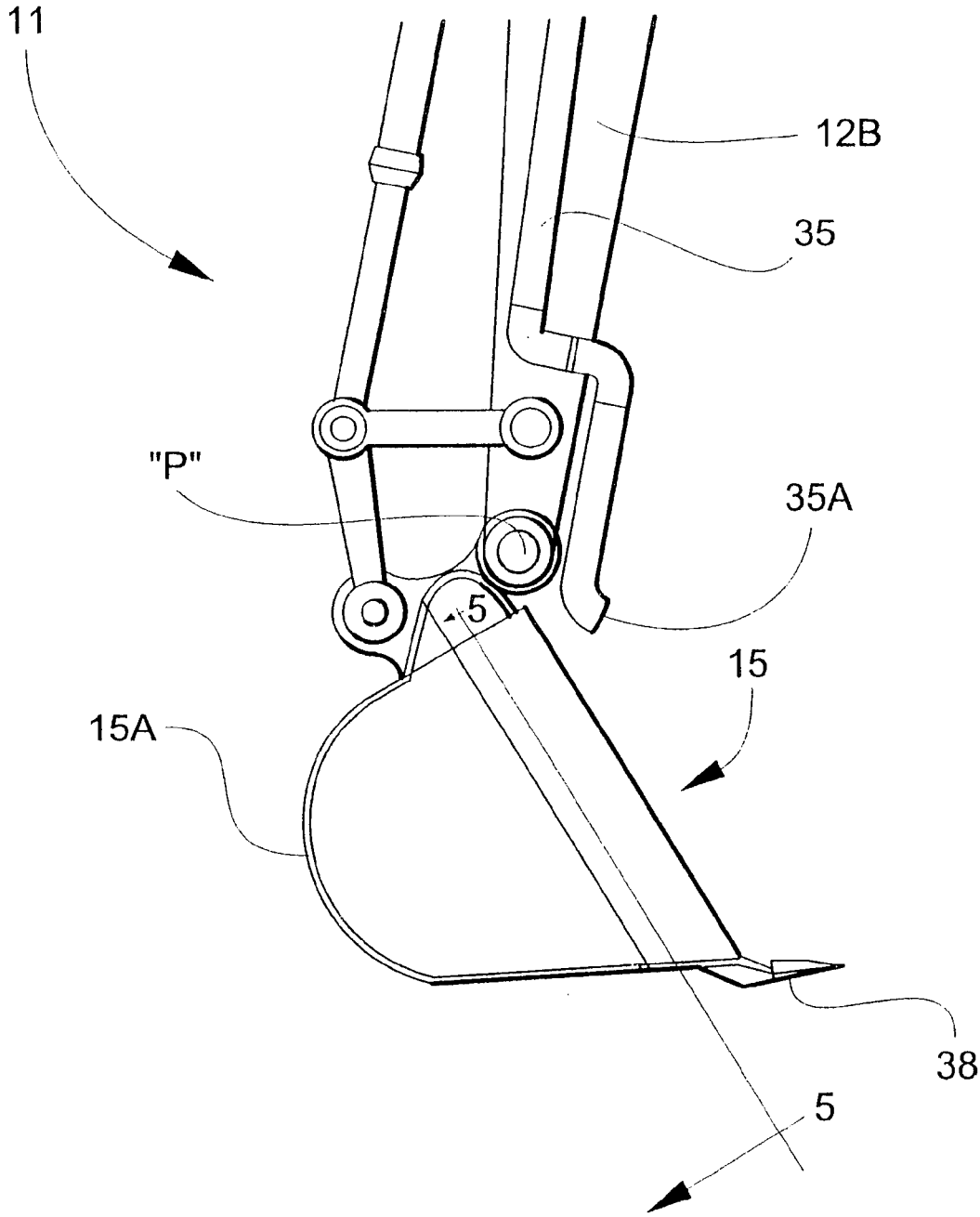
FIG. 4 is a fragmentary view of the working arm of the vehicle, and showing the location of the reagent delivery line relative to the mixing bucket.

As shown in FIG. 4, the discharge end 35A of the delivery line 35 is centrally located at the mouth of the bucket 15, and is angled slightly to discharge reagent slurry to a predetermined target area directly adjacent to and forward of the bucket 15. As the bucket 15 is pulled by the working arm 12 through the lagoon "L" in a direction towards the vehicle 10, the reagent slurry exiting the delivery line 35 is immediately captured by the bucket 15 and mixed with the sludge waste. The lagoon "L" is preferably divided in notional cells, and treated from the bottom up in a series of sweeping lifts extending from a far side of the cell to a near side of the cell. The depth of the cells in some areas of the lagoon may be from 20 to 25 feet. After treatment, the reagent slurry causes the sludge waste to harden over a period of about 7 to 21 days.

Figure 5:
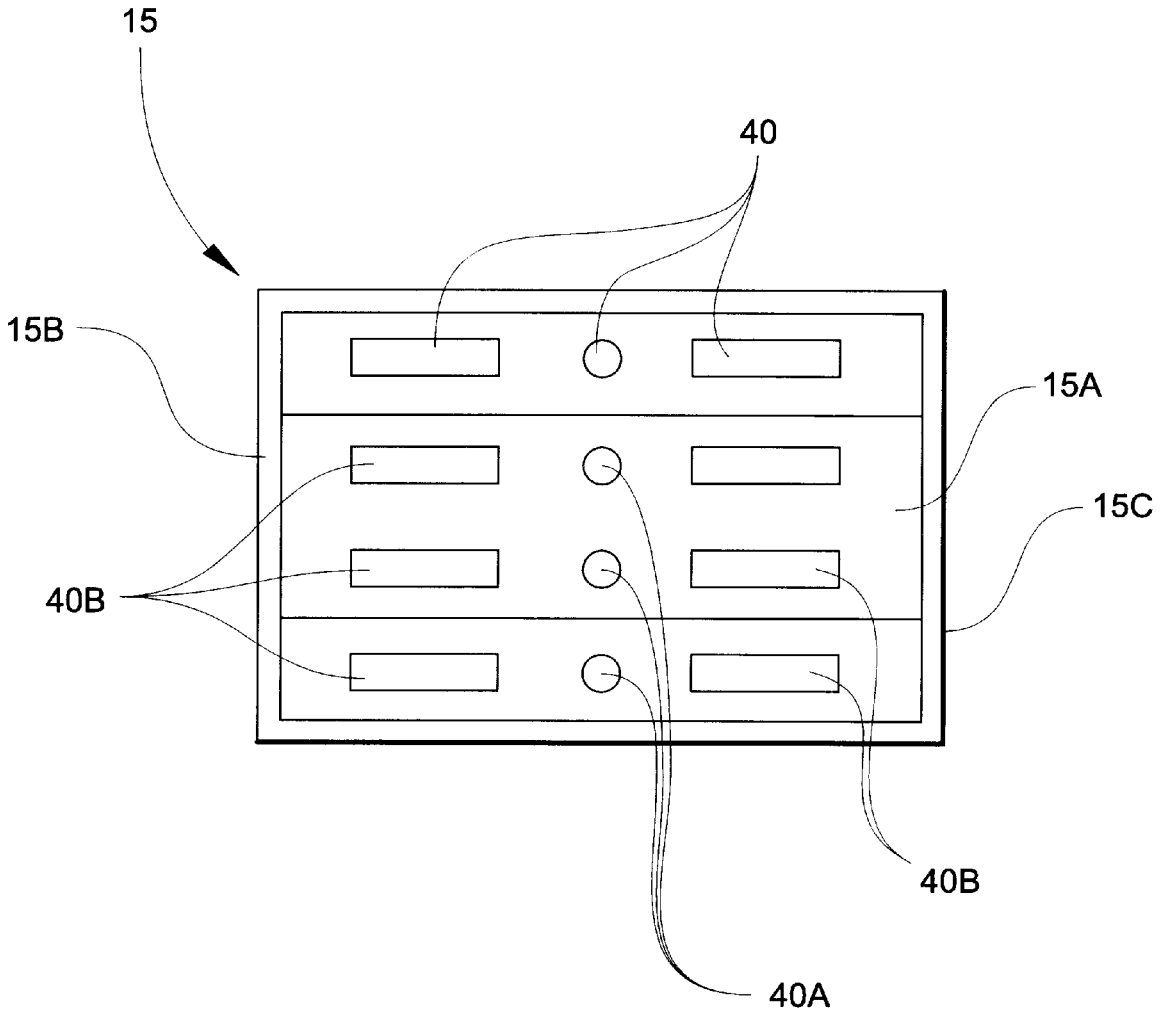
FIG. 5 is a cross-sectional view taken substantially along line 5—5 at the mouth of the bucket, and looking inwardly to show the arrangement of waste sifting openings formed in the bucket.

Referring to FIGS. 4 and 5, the mixing bucket 15 is mounted on the free end of the stick 12B, and is pivotable a forward and rearward direction about a fixed point "P". A number of teeth 38 formed along a bottom edge of the bucket 15 facilitate its movement into and through the sludge lagoon "L". The teeth 38 are especially applicable for breaking up larger masses of solid and semi-solid waste.

As shown in FIG. 5, the contoured wall 15A of the bucket 15 extending from a top edge to the bottom edge includes a plurality of spaced-apart waste sifting openings 40 adapted for sifting and mixing the sludge waste as the bucket 15 is pulled through the lagoon "L". The bucket 15 immediately captures reagent slurry discharged into the target area, uniformly mixes the reagent and sludge waste together, and then passes the treated mixture through the openings 40 as further untreated waste moves into the target area. The openings 40 create a slight vacuum force on a back side of the bucket 15 which helps contain the reagent slurry in the target area during mixing. Moreover, the openings 40 sift the waste and help break up larger masses for more effective processing.

A first set of openings 40 includes relatively small holes 40A formed primarily in a center portion of the bucket 15. According to one embodiment, the diameter of each hole is about 3½ inches. A second set of openings 40 includes relatively large spaced-apart slots 40B formed on either side of the holes 40A. The dimension of each slot is about 13 inches by 3½ inches. As the bucket 15 sweeps through the lagoon "L", the arrangement of smaller holes 40A in the center of the bucket 15 and closer to the discharge end 35A of the delivery line 35 promotes more uniform mixing of reagent and sludge waste by limiting direct passage of reagent through the bucket 15. The larger slots 40B are closer to respective opposing side walls 15B and 15C of the bucket 15, and allow increased passage of reagent and sludge waste through the bucket 15 after mixing. The side walls 15B and 15C are preferably solid.

A waste processing attachment for a backhoe excavator is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In combination with a self-propelled vehicle for being moved over a supporting surface, and having a moveable working arm adapted for reaching outwardly from said vehicle and downwardly beneath an adjacent surface of a waste lagoon, a waste processing attachment for injecting and mixing a waste processing material into the lagoon, said waste processing attachment comprising:

(a) a bucket mounted on a free end of the moveable working arm, and including a plurality of spaced-apart waste sifting openings therein;

(b) a material delivery line extending along the working arm of said vehicle, and having a connecting end connected to a material supply source and a discharge end residing proximate said bucket, whereby waste processing material passing through and exiting said delivery line beneath the surface of the waste lagoon is discharged into a target area directly adjacent said bucket and mixed with the waste as said bucket is carried by the working arm through the lagoon.

2. A combination according to claim 1, wherein said waste sifting openings comprise an arrangement of relatively small, spaced-apart holes formed in said bucket.

3. A combination according to claim 1, wherein said waste sifting openings comprise an arrangement of relatively large spaced-apart slots formed in said bucket.

4. A combination according to claim 1, wherein said waste sifting openings formed in said bucket comprise a first arrangement of relatively small spaced-apart holes and a second arrangement of relatively large spaced-apart slots.

5. A combination according to claim 4, wherein the open area defined by each slot is at least 4 times greater that the open area defined by each hole.

6. A combination according to claim 2, wherein the open area defined by each hole is between 8 and 10 square inches.

7. A combination according to claim 3, wherein the open area defined by each slot is between 40 and 50 square inches.

8. A combination according to claim 1, and comprising a plurality of teeth formed along a bottom edge of said bucket to facilitate movement of said bucket into and through the waste lagoon.

9. A combination according to claim 1, wherein said vehicle comprises a backhoe excavator.

10. A combination according to claim 1, wherein said material delivery line includes a section of steel pipe mounted to the working arm of said vehicle and terminating at a point adjacent to and forward of said bucket.

11. A waste processing attachment for use in combination with a self-propelled vehicle, the vehicle being adapted for movement over a supporting surface and having a moveable working arm for reaching outwardly from the vehicle and downwardly beneath an adjacent surface of a waste lagoon, said waste processing attachment comprising:

(a) a bucket for being mounted on a free end of the moveable working arm, and including a plurality of spaced-apart waste sifting openings therein; and (b) material delivery means for delivering waste processing material to a target area directly adjacent said bucket, such that waste processing material injected by said delivery means beneath the surface of the lagoon is mixed with the waste as said bucket is moved by the working arm through the lagoon.

12. A waste processing attachment according to claim 11, wherein said waste sifting openings comprise an arrangement of relatively small, spaced-apart holes formed in said bucket.

13. A waste processing attachment according to claim 11, wherein said waste sifting openings comprise an arrangement of relatively large spaced-apart slots formed in said bucket.

14. A combination according to claim 11, wherein said waste sifting openings formed in said bucket comprise a first arrangement of relatively small spaced-apart holes and a second arrangement of relatively large spaced-apart slots.

15. A waste processing attachment according to claim 14, wherein the open area defined by each slot is at least 4 times greater that the open area defined by each hole.

16. A waste processing attachment according to claim 12, wherein the open area defined by each hole is between 8 and 10 square inches.

17. A waste processing attachment according to claim 13, wherein the open area defined by each slot is between 40 and 50 square inches.

18. A waste processing attachment according to claim 11, and comprising a plurality of teeth formed along a bottom edge of said bucket to facilitate movement of said bucket into and through the waste lagoon.

19. A method for environmentally treating a waste lagoon using a self-propelled vehicle adapted for movement over a supporting surface and having a moveable working arm for reaching outwardly from the vehicle and downwardly beneath an adjacent surface of the waste lagoon, said method comprising the steps of:

(a) mounting a bucket on a free end of the moveable working arm, the bucket having a plurality of spaced-apart waste sifting openings therein;

(b) locating a discharge end of a material delivery line proximate the bucket, and connecting an opposite end of the material delivery to a material supply source;

and (c) manipulating the working arm to move the bucket into and through the lagoon while simultaneously delivering waste processing material from the supply source through the delivery line to a target area directly adjacent said bucket, whereby the working arm and bucket cooperate to mix the processing material and waste together to environmentally treat the lagoon.

* * * * *